US006116548A

United States Patent [19]

Oleson

[11] Patent Number: 6,116,548

[45] Date of Patent: Sep. 12, 2000

[54] APPARATUS FOR FILLING PAPER LAWN REFUSE BAGS

[76] Inventor: Vernon L. Oleson, 2023 Towne Lake Hills West, Woodstock, Ga. 30189

[21] Appl. No.: 09/108,611

[22] Filed: Jul. 1, 1998

[51] Int. Cl.[7] ..... A63B 55/04; B65B 67/04

[52] U.S. Cl. ..... 248/97; 248/99; 248/100

[58] Field of Search ..... 248/97, 95, 99, 248/100, 101, 146, 684, 94, 98; 220/9.1, 9.4, 908, 908.3; 141/391, 314, 331; 383/33, 34, 34.1

[56] References Cited

U.S. PATENT DOCUMENTS

| | | | |
|---|---|---|---|
| 98,553 | 1/1870 | Burke | 248/101 |
| 434,514 | 8/1890 | Lamb | 248/100 |
| 725,721 | 4/1903 | Kenney | 248/97 |
| 904,695 | 11/1908 | Herrick | 248/97 |
| 999,406 | 8/1911 | Skelton | 248/97 |
| 1,375,590 | 4/1921 | Hurlbutt | 248/99 |
| 2,504,572 | 4/1950 | Nygard | 248/97 |
| 3,260,488 | 7/1966 | Kliewer et al. | 248/99 |
| 4,200,127 | 4/1980 | Dunleavy | 141/10 |
| 4,273,167 | 6/1981 | Stillwell | 141/134 |
| 4,470,627 | 9/1984 | Carroll et al. | 294/55 |
| 4,832,292 | 5/1989 | Beckham | 248/99 |
| 4,834,260 | 5/1989 | Auten | 220/404 |
| 4,917,393 | 4/1990 | Rogers | 280/41.28 |
| 4,948,004 | 8/1990 | Chich | 220/1 T |
| 4,971,274 | 11/1990 | Mitchell | 248/101 |
| 4,979,547 | 12/1990 | Hoerner | 141/390 |
| 5,011,103 | 4/1991 | Hayes et al. | 248/99 |
| 5,014,943 | 5/1991 | Nelson et al. | 248/99 |
| 5,031,277 | 7/1991 | Coker | 15/257.3 |
| 5,031,948 | 7/1991 | Groth et al. | 294/1.1 |
| 5,040,754 | 8/1991 | Dearman | 248/97 |
| 5,048,778 | 9/1991 | Wright | 248/98 |
| 5,195,765 | 3/1993 | Lacey, Jr. | 280/47.26 |
| 5,406,777 | 4/1995 | Porto | 53/513 |
| 5,593,117 | 1/1997 | Alexander, III | 248/99 |
| 5,597,145 | 1/1997 | Meyers et al. | 248/97 |
| 5,868,364 | 2/1999 | MacMillan | 248/97 |

*Primary Examiner*—Anita M. King
*Attorney, Agent, or Firm*—Gardner & Groff, P.C.

[57] ABSTRACT

An apparatus for supporting and filling a paper lawn refuse bag includes a support frame and a hopper mounted thereon with the hopper including a funnel-like upper portion and a chute-like lower portion in communication therewith. Locking plates are pivotably mounted to the hopper for movement between raised and lowered positions, with the locking plates including gripping elements for gripping an upper portion of a lawn refuse bag when the locking plates are in their lowered position. In one form, the gripping elements comprise pins for piercing the upper portion of the paper lawn refuse bag.

15 Claims, 4 Drawing Sheets

APPARATUS FOR FILLING PAPER LAWN REFUSE BAGS

TECHNICAL FIELD

The present invention relates generally to lawn and garden equipment and in particular relates to an apparatus for filling paper lawn refuse bags.

BACKGROUND OF THE INVENTION

In recent years, many municipalities and other locales have adopted a policy of encouraging or requiring the use of paper lawn refuse bags. The rationale for adopting paper as the material of choice for lawn refuse bags is that the paper bags, when placed in a landfill, are more biodegradable than plastic bags. In other words, the paper lawn refuse bags break down more easily in the landfill, thereby making it easier to reclaim the land in the landfill. While paper lawn refuse bags represent a growing trend and are easier on the environment, they nonetheless have some practical difficulties in their use.

For example, paper lawn refuse bags are less flexible and somewhat more awkward to use than plastic lawn refuse bags. This can make the filling of the paper lawn refuse bags tedious and difficult. This general shortcoming of paper lawn refuse bags has been recognized in the prior art. For example, U.S. Pat. No. 5,195,765 of Lacy Jr. relates to a paper sack holding dolly with a top entry guide and a bag top to guide the shank-holding strap. The '765 patent discloses a wheeled dolly (stand) for supporting a paper lawn refuse bag during filling. However, the '765 patent fails to teach a convenient means for holding the top of the bag open during loading, nor does it teach or suggest a reliable mechanism for holding such a bag up during filling to prevent the collapse of the bag.

U.S. Pat. No. 5,406,777 of Porto relates to a grass hopper cart which consists of a cabinet and a structure within the cabinet for holding a standard paper lawn refuse bag in an opened stationary position. The '777 patent discloses a hopper in the cabinet above the holding structure so that the grass cuttings are dumped into the hopper and into the paper bag for proper disposal.

Despite these laudable efforts in the prior art, there exists yet a need for an apparatus for filling paper lawn refuse bags which is easily used, is highly effective for supporting the bag during filling, is particularly effective for keeping the top of the bag open during filling, and is simple in its construction and operation. It is to the provision of such an apparatus that the present invention is primarily directed.

SUMMARY OF THE INVENTION

Briefly described, in a first preferred form, the present invention comprises an apparatus for filling a paper lawn refuse bag. The apparatus includes a support frame and a hopper mounted to the support frame and supported thereby. The hopper includes a funnel-like upper portion and a chute-like lower portion in communication with the funnel-like upper portion. The hopper further includes a plurality of movable locking plates for releasably securing an upper portion of a paper lawn refuse bag to the chute-like lower portion of the hopper.

Preferably, the movable locking plates are pivoted for movement between a raised position adjacent the funnel-like upper portion and a lowered position adjacent the chute-like lower portion. Also, preferably the locking plates each include a piercing member for piercing the upper portion of the paper lawn refuse bag, with the chute-like lower portion of the hopper including a plurality of slots for receiving the piercing members therein. Also preferably, the locking plates are each pivoted adjacent a junction between the funnel-like upper portion and the chute-like lower portion. In a modified form, the piercing members are dispensed with and each of the locking plates includes a recess and the chute-like lower portion includes a plurality of projections for cooperating with the recesses for releasably gripping the upper portion of the paper lawn refuse bags.

To make it easier to insert and remove a paper lawn refuse bag, the hopper can be provided with a movable door. The movable door can be formed in the chute-like lower portion of the hopper or, alternatively, it can be formed in both the lower chute-like portion and the upper funnel-like portion.

In another preferred form, the invention comprises an apparatus for filling a paper lawn refuse bag, with the apparatus including a hopper adapted to be placed over a rigid trash can with a paper lawn refuse bag placed within the trash can. The hopper includes a funnel-like upper portion and a chute-like lower portion in communication with the funnel-like upper portion. The hopper further includes a plurality of pivotable locking plates each having at least one gripping means for releasably gripping an upper portion of a paper lawn refuse bag.

Preferably, the means for releasably gripping the upper portion of a paper lawn refuse bag includes a piercing element for piercing the upper portion of the paper lawn refuse bag. Also preferably, the chute-like lower portion of the hopper includes a plurality of slots formed therein for receiving the piercing elements.

An apparatus according to the invention just described has numerous advantages. For example, the invention is very effective in assisting a user in filling a paper lawn refuse bag. In doing so, it meets two very important objectives. Firstly, it holds the bag upright and open as the user begins to fill the bag. Secondly, as the lawn refuse falls into the bag, the invention continues to hold the paper lawn refuse bag up, despite loads placed on the side of the bag which might otherwise tend to tip the bag over or collapse the bag. In addition to being highly effective in assisting filling of the paper lawn refuse bags, the invention also makes it very easy to fill the paper lawn refuse bags. Moreover, the invention itself is very easy to use in terms of placing a paper lawn refuse bag in the apparatus, securing it, filling the bag, and removing the filled bag. Furthermore, the invention results in a very lightweight apparatus which is easily moved from place to place. Also, the apparatus is rugged, simple, and quite durable. It also is very economical to manufacture.

Accordingly, it is a primary object of the present invention to provide an apparatus for filling paper lawn refuse bags which is highly effective at holding the bag upright and open as one begins to fill the bag and as the bag becomes substantially filled.

It is another object of the present invention to provide an apparatus for filling paper lawn refuse bags which is easily used to fill such bags.

It is another object of the present invention to provide a lightweight apparatus for filling paper lawn refuse bags, which apparatus can be moved from place to place easily.

It is another object of the present invention to provide an apparatus for filling paper lawn refuse bags, which apparatus is simple, rugged, economical, and durable.

These and other objects, features, and advantages of the present invention will become more apparent upon reading the following specification in conjunction with the accompanying drawing figures.

BRIEF DESCRIPTION OF THE DRAWING FIGURES

Figure 1:
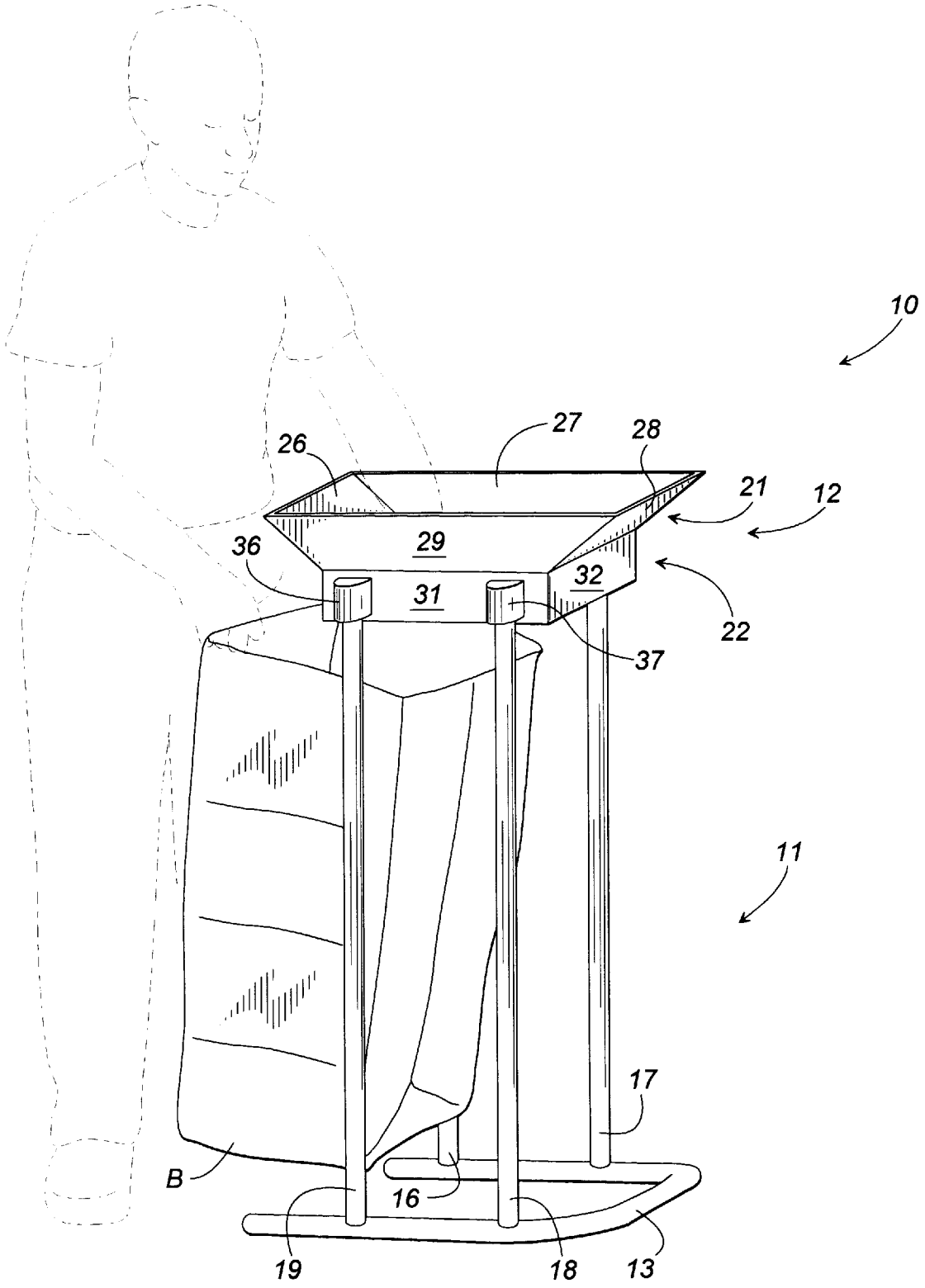
FIG. 1 is a perspective illustration of an apparatus for filling a paper lawn refuse bag according to a preferred form of the invention.
Figure 5:
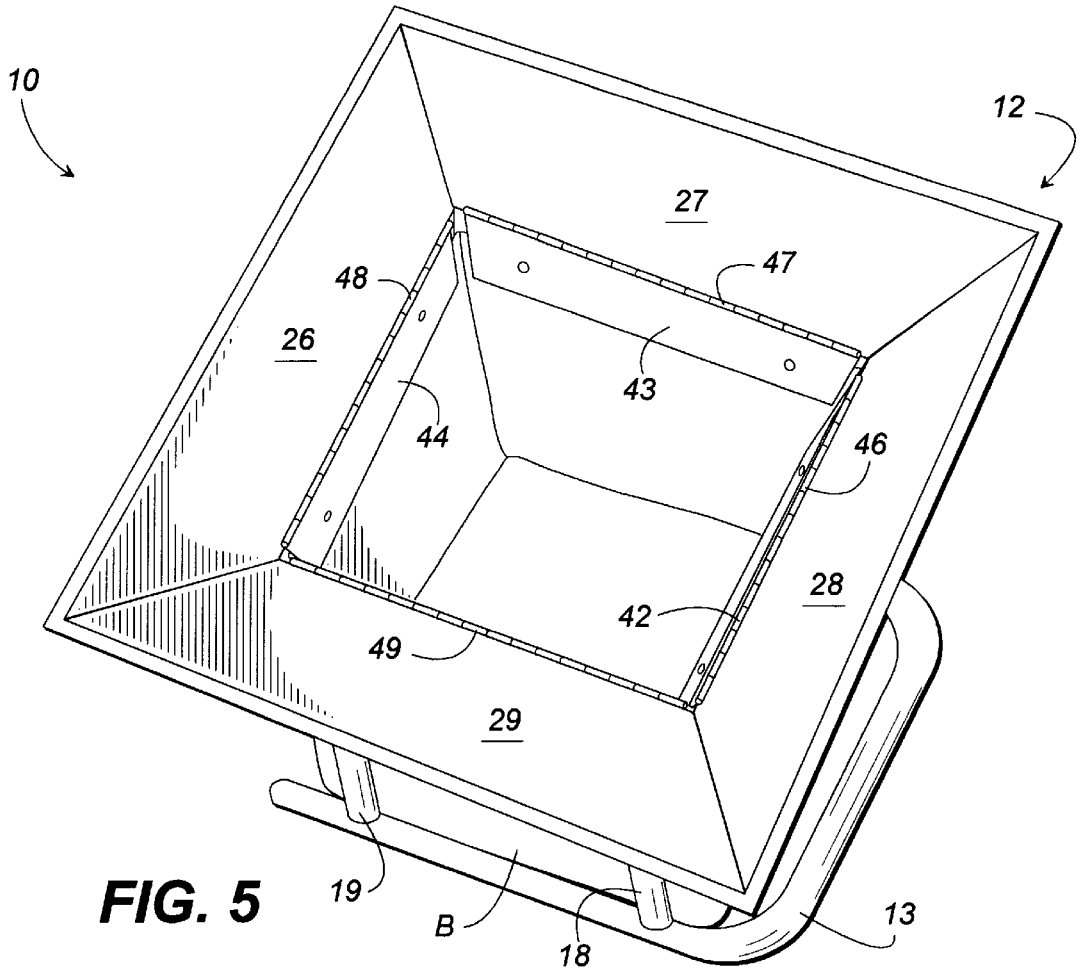

FIG. 5 a top, right perspective view of the apparatus of FIG. 1, shown in conjunction with a paper lawn refuse bag.

Figure 6:
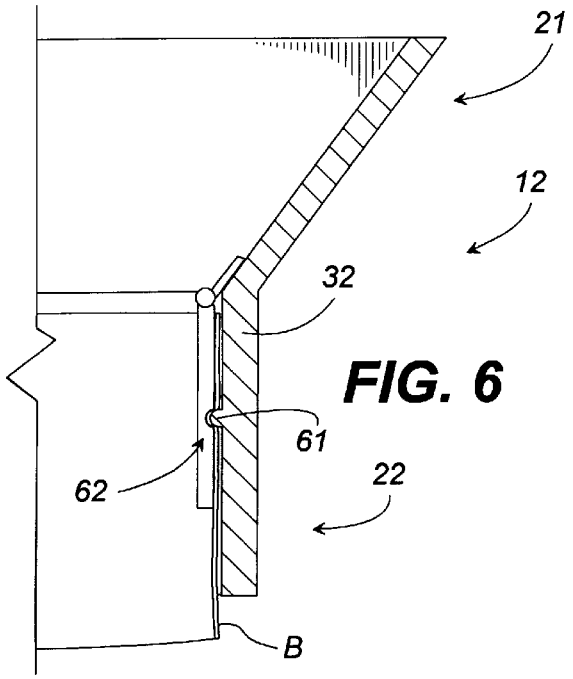

FIG. 6 is a sectional view of a portion of an apparatus according to a modified form of the invention.

Figure 7:
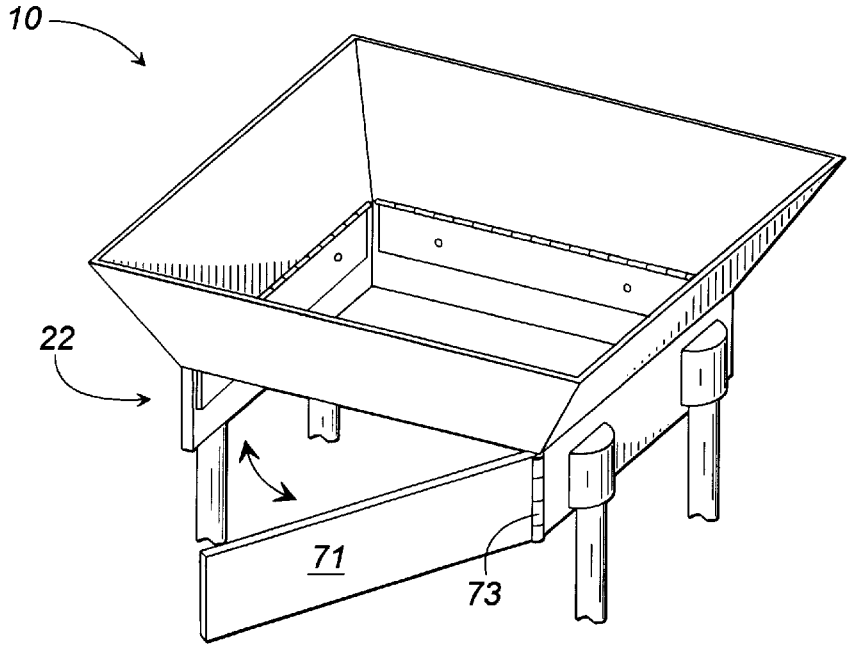

FIG. 7 is a perspective illustration of a portion of an apparatus for filling paper lawn refuse bags according to another modified form of the invention.

Figure 8:
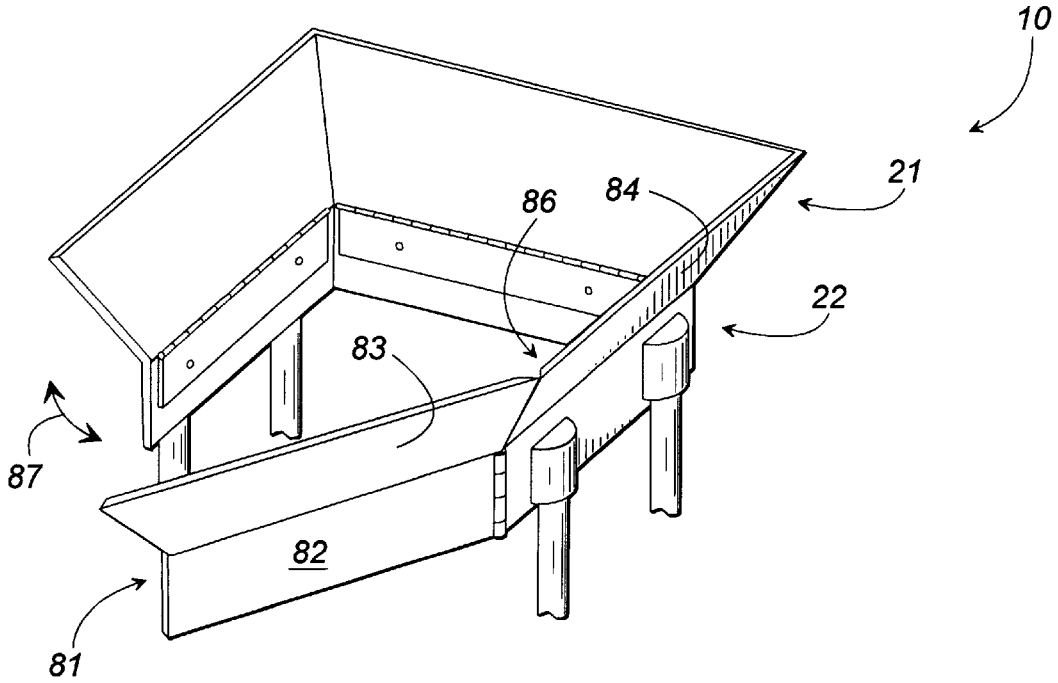

FIG. 8 a perspective illustration of an apparatus for filling paper lawn refuse bags according to yet another modified form of the invention.

DETAILED DESCRIPTION OF THE PREFERRED EMBODIMENTS

Referring now in detail to the drawing figures, wherein like reference numerals represent like parts throughout the several views, FIG. 1 shows an apparatus 10 for filling paper lawn refuse bags, such as bag B shown in the figure. Apparatus 10 is useful for holding a paper lawn refuse bag B upright and open. This apparatus 10 is useful both for the initial filling and for completing the filling. During the initial filling, the apparatus is effective for holding the bag both upright and open. The apparatus 10 also is very effective for continuing to hold the bag upright and open, even as the bag begins to fill and load forces acting on the bag tend to cause it to want to topple over or collapse.

The apparatus 10 includes a support frame 11 and a hopper 12 supported thereon. The support frame 11 includes a U-shaped base 13 and four (4) upright legs or stations 16–19. The U-shaped base and the legs can be made of aluminum, PVC (polyvinylchloride), or any other suitable lightweight, rigid material. The legs 16 and 17 are spaced from legs 18 and 19 a distance sufficient to allow a paper lawn refuse bag B to be inserted therebetween for receiving grass clippings, tree trimmings, other lawn refuse, etc. While the use of four (4) legs and a U-shaped base is shown in the figure, other configurations can be utilized as well. For example, the individual legs can be dispensed with and a solid sheet of material substituted therein for making a drum-shaped or conically-shaped support frame. Moreover, the support frame, while shown in the drawing figure to be useful for supporting the hopper above the ground, can be instead designed to be fitted atop a rigid trash can. In this regard, a paper lawn refuse bag can be placed inside of a trash can and the apparatus set atop the trash can for filling the paper lawn refuse bag. To facilitate this, instead of having a support frame that extends vertically downwardly, the support frame should extend horizontally outwardly to support the hopper above the rim of a trash can.

The hopper 12 includes a funnel-like upper portion 21 and a chute-like lower portion 22. Preferably, the funnel-like upper portion 21 and the chute-like lower portion 22 are molded together as a unitary item. Preferably, the hopper 12 is made from polyvinylchloride, polyurethane, polyester, or some other suitable lightweight plastic material. The hopper 12 can be made of aluminum or another metal, but at generally higher cost. The funnel-like upper portion 21 is rectangular and the funnel-like upper portion includes four (4) trapezoidal sections 26–29, with the trapezoidal sections adjoining one another. The chute-like lower portion 22 includes a plurality of rectangular sections 31–34 (only two of which are visible in FIG. 1).

Figure 2:
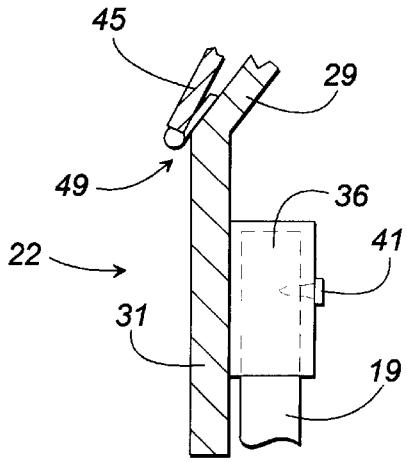
FIG. 2 is a detailed, sectional view of a portion of the apparatus of FIG. 1.

Sockets, such as sockets 36 and 37, are integrally formed on the sides of the rectangular sections 31, 33 for receiving and rigidly securing the upper ends of the support legs, such as support legs 18 and 19. The sockets can be provided with a smooth bore for receiving the cylindrical upper end of the support leg. In this regard, the support leg and the smooth bore can be coated with PVC cement prior to inserting the leg into the bore to effectively adhere or weld the leg to the socket. Alternatively, to allow the apparatus 10 to be broken down for compact storage, adhesives can be avoided and the upper end of the support leg can be removably received in the socket. For example, as shown in FIG. 2, support leg 19 is removably received inside socket 36 and is held in place by the fastener 41 screwed into the socket and into the support leg 19. In this way, the leg is securely mounted to the socket (which in turn is securely mounted to or integrally formed with rectangular section 31 of the chute-like lower portion 22).

Figure 3:
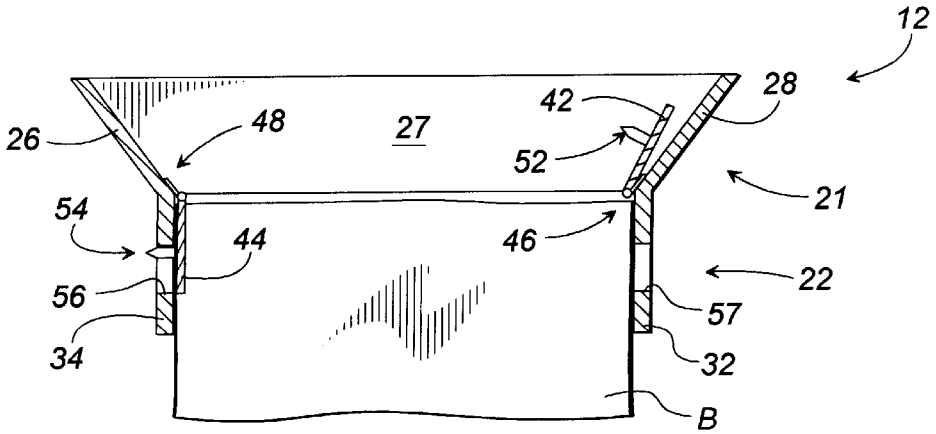
FIG. 3 is a sectional view of a portion of the apparatus of FIG. 1 with some elements removed.

Referring now to FIGS. 2, 3, and 5, the hopper 12 can be seen to include four (4) pivotable locking plates, such as locking plates 42–45. The locking plates are pivotably mounted to the hopper 12 at the juncture of the funnel-like upper portion 21 and the chute-like lower portion 22. For mounting the pivotable locking plates to the hopper, four (4) piano-type hinges 46–49 are provided.

As best seen in FIG. 3, each of the pivotable locking plates includes one or more piercing elements, such as piercing pin 52 on locking plate 42 and piercing pin 54 on locking plate 44. The piercing elements can take a variety of shapes. For example, they can be shaped similar to a roofing nail or can be shaped like a threaded fastener. If the piercing elements have reasonably sharp points, they can more easily pierce the upper portion of the bag B. However, relatively dull points have less tendency to snag or scratch a user when the locking plates are in their upper position (see the right half of FIG. 3). With the locking plates in their lowered position, as shown in FIG. 5 and as shown in the left half of FIG. 3, the piercing elements are forced through the upper portion of the bag B and extend through slots, such as slots 56 and 57, in the chute-like lower portion 22 of the hopper 12. The slots are elongated vertically to allow the piercing elements to swing into position. However, the width of the slots can be maintained to be only slightly greater than the diameter of the piercing elements.

While the use of a smooth shafted piercing element eases insertion of the piercing element through the upper portion of the bag B, it does so at the expense of a little effectiveness of the grip on the bag. In this regard, it is pointed out that the applicant has found that the use of a piercing element that has threads or thread-like projections helps to hold the bag upright better by keeping the now formed perforation in the bag from sliding along the shaft of the piercing element.

Figure 4:
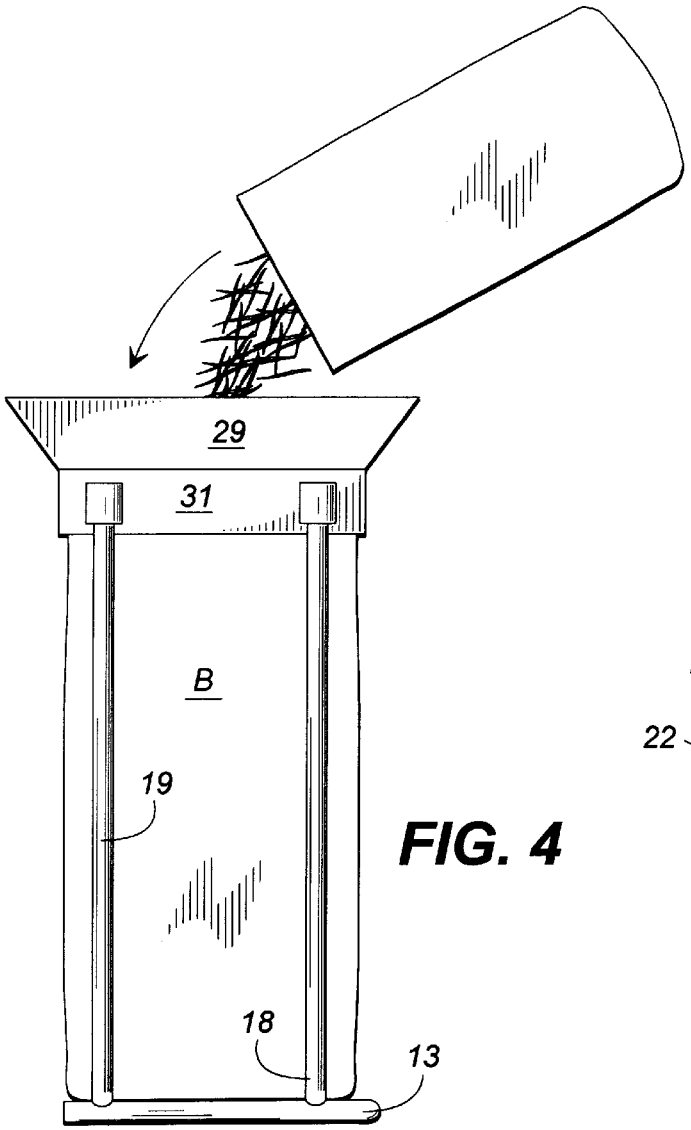
FIG. 4 is a elevation view of the apparatus of FIG. 1 shown in use.

To use the apparatus 10 just described, initially one would start with the locking plates in their up or raised position. From this configuration, one inserts a bag B as shown in FIG. 1. With the bag situated beneath the hopper 12 and with the upper portion of the bag B resting just inside the periphery of the chute-like lower portion 22, one then flips the locking plates down to their lowered position one at a time. With the locking plates in their lowered position, the upper portion of the bag B is held quite firmly and is held open and upright. One can then fill the paper lawn refuse bag B, such as depicted in FIG. 4.

Referring now to FIG. 6, a modified form of the apparatus is shown. As shown in FIG. 6, the hopper 12 includes a funnel-like upper portion 21 and a chute-like lower portion 22. However, instead of slots being formed in the rectangular sections of the lower portion 22 as is the case in the first embodiment, here, projections or nibs are formed in the rectangular sections of the lower portion 22 and extend inwardly. For example, rectangular section 32 includes an inwardly extending nib 61. Furthermore, the locking plates are modified to include sockets or recesses, such as socket 62 for receiving the nibs therein. In this way, as the locking plates are folded down to their lowered position as depicted in FIG. 6, the nibs project inwardly into the sockets and capture a portion of the upper part of the bag B therein. In this regard, it is pointed out that the nib and socket arrangement need not pierce the bag in order to securely grip it. The nib and socket arrangement can be in the form of ball-shaped nibs and correspondingly ball-shaped sockets. Alternatively, the nibs can be in the form of elongated ridges and the sockets can be in the form of elongated slots or troughs (with the elongation running horizontally).

FIGS. 7 and 8 show another modified version of the present invention. These figures show the use of a swinging door to ease the insertion and removal of a paper lawn refuse bag into and out of the apparatus 10. As shown in FIG. 7, the door takes the form of a rectangular section 71 forming part of the chute-like lower portion 22. The rectangular door is pivoted about a hinge 73. An unshown clasp is used to hold the door in its closed position when desired.

FIG. 8 shows another arrangement of a swinging door in which the swinging door 81 includes a rectangular panel 82 and a trapezoidal panel 83. It is pointed out that the door 81 thusly is formed from a part of both the chute-like lower portion 22 and the funnel-like upper portion 21. It should be noted that the hinge shown in FIG. 8 is for schematic purposes only. Those skilled in the art will recognize that the pivot access for the hinge will need to lie at or outside the corner of trapezoidal panel 83 with its adjacent neighbor trapezoidal panel 84 (the corner indicated at 86) in order to avoid binding as the door is swung back and forth in the direction of direction arrow 87.

While the invention has been disclosed in preferred forms, those skilled in the art will recognize that many modifications, additions and deletions may be made therein without departing from the spirit and scope of the invention as set forth in the following claims.

What is claimed is:

1. An apparatus for supporting and filling a paper lawn refuse bag, said apparatus comprising:

a support frame;

a hopper mounted to said support frame and supported thereon, said hopper including a funnel-like upper portion and a chute-like lower portion in communication with said funnel-like upper portion, said chute-like lower portion having an interior surface; and a plurality of movable lamps mounted inside said hopper for releasably securing an upper portion of the paper lawn refuse bag to said interior surface of said chute-like lower portion of said hopper.

2. An apparatus as claimed in claim 1 wherein said movable clamps comprise pivotable locking plates.

3. An apparatus as claimed in claim 1 wherein said movable clamps are mounted for pivotable movement between a raised position adjacent an interior surface of said funnel-like upper portion and a lowered position adjacent said interior surface of said chute-like lower portion.

4. An apparatus as claimed in claim 1 wherein said hopper includes a movable door portion for easing insertion and removal of the paper lawn refuse bag.

5. An apparatus as claimed in claim 4 wherein said movable door portion comprises a movable portion of said chute-like lower portion of said hopper.

6. An apparatus as claimed in claim 4 wherein said movable door portion comprises a movable portion of said chute-like lower portion and of said funnel-like upper portion.

7. An apparatus as claimed in claim 1 wherein said hopper is generally rectangular.

8. An apparatus as claimed in claim 7 wherein said plurality of movable clamps comprises four (4) locking plates mounted for pivotable movement.

9. An apparatus as claimed in claim 8 wherein said locking plates are each pivoted about an axis adjacent a juncture of said funnel-like upper portion and said chute-like lower portion.

10. An apparatus as claimed in claim 1 wherein said movable clamps each include a recess, and wherein said chute-like lower portion includes a plurality of projections for cooperating with said recesses for releasably gripping the upper portion of the paper lawn refuse bag.

11. An apparatus for supporting and filling a paper lawn refuse bag, said apparatus comprising:

a support frame: and a hopper mounted to said support frame and supported thereon, said hopper including a funnel-like upper portion and a chute-like lower portion in communication with said funnel-like upper portion, said hopper further including a plurality of movable clamps for releasably securing an upper portion of the paper lawn refuse bag to said chute-like lower portion of said hopper, wherein said clamps each include a piercing member for piercing the upper portion of the paper lawn refuse bag.

12. An apparatus as claimed in claim 11 wherein said chute-like lower portion includes a plurality of slots formed therein for receiving said piercing members therein.

13. An apparatus for supporting and filling a bag, said apparatus comprising:

a hopper including a funnel-like upper portion and a chute-like lower portion in communication with said funnel-like upper portion, said hopper further including a plurality of pivotable clamps having gripping means for releasably gripping an upper portion of the bag, said pivotable clamps being mounted for pivotal movement between a lower position adjacent an interior surface of said chute-like lower portion for clamping the bag thereagainst and an upper position, and with said pivotable clamps in said lower position, said gripping means releasably grips an upper portion of the bag to secure it to said chute-like lower portion, wherein said gripping means for releasably gripping comprises piercing means for piercing the upper portion of the bag.

14. An apparatus as claimed in claim 13 wherein said chute-like lower portion includes a plurality of slots for receiving said piercing means therein.

15. An apparatus as claimed in claim 13 wherein said hopper is generally rectangular.

* * * * *